US009630788B2

(12) United States Patent
Horita et al.

(10) Patent No.: US 9,630,788 B2
(45) Date of Patent: Apr. 25, 2017

(54) PAPER OUTPUT TRAY, PAPER OUTPUT UNIT INCORPORATING SAME, AND IMAGE FORMING APPARATUS INCORPORATING SAME

(71) Applicant: Ricoh Company, Ltd., Ohata-ku, Tokyo (JP)

(72) Inventors: Hirofumi Horita, Osaka (JP); Ippei Kimura, Osaka (JP); Yasuo Matsuyama, Hyogo (JP); Mizuna Tanaka, Osaka (JP); Ikuo Fujii, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/050,684

(22) Filed: Oct. 10, 2013

(65) Prior Publication Data

US 2014/0103603 A1 Apr. 17, 2014

(30) Foreign Application Priority Data

Oct. 12, 2012 (JP) ..... 2012-226860

(51) Int. Cl.

*B65H 1/00* (2006.01)
*B65H 31/20* (2006.01)
*B65H 85/00* (2006.01)

(Continued)

(52) U.S. Cl.

CPC ..... *B65H 1/00* (2013.01); *B65H 5/062* (2013.01); *B65H 31/02* (2013.01); *B65H 31/20* (2013.01);

(Continued)

(58) Field of Classification Search

CPC ..... B65H 2405/1116; B65H 2405/11161–2405/11164;

(Continued)

(56) References Cited

U.S. PATENT DOCUMENTS 7,547,015 B2 * 6/2009 Lee et al. ..... 271/213
8,087,666 B2 * 1/2012 Honda et al. ..... 271/220

(Continued)

FOREIGN PATENT DOCUMENTS

JP 2003-040513 2/2003
JP 2003-040516 2/2003

(Continued)

*Primary Examiner* — Patrick Cicchino
(74) *Attorney, Agent, or Firm* — Harness, Dickey & Pierce, P.L.C.

(57) ABSTRACT

A paper output tray, which can be included in a paper output unit in an image forming apparatus, includes a tray body, a paper support extension slidably attached to the tray body and arranged switchable between a stored state in which the paper support extension is stored in the tray body and an extended state in which the paper support extension is pulled out to extend from the tray body, and a stopper rotatably attached to the paper support extension and arranged switchable between a folded state in which the stopper is folded to the paper support extension and a standing state in which the stopper is raised from the paper support extension. With the paper support extension in the stored state and the stopper in the folded state, the stopper overlaps an outer surface of the tray body.

21 Claims, 11 Drawing Sheets

(51) Int. Cl.
*B65H 5/06* (2006.01)
*G03G 15/00* (2006.01)
*B65H 31/02* (2006.01)

(52) U.S. Cl.
CPC ..... *B65H 85/00* (2013.01); *G03G 15/6552* (2013.01); *B65H 2301/4212* (2013.01); *B65H 2401/115* (2013.01); *B65H 2402/441* (2013.01); *B65H 2402/46* (2013.01); *B65H 2405/1124* (2013.01); *B65H 2405/11164* (2013.01); *B65H 2405/111646* (2013.01); *B65H 2801/06* (2013.01); *B65H 2801/09* (2013.01)

(58) Field of Classification Search
CPC .. B65H 2405/111646; B65H 2405/112; B65H 2404/775; B65H 31/02; B65H 31/20
USPC ..... 271/207, 217, 223, 224
See application file for complete search history.

(56) References Cited

U.S. PATENT DOCUMENTS

| | | | | |
|---|---|---|---|---|
| 8,219,020 | B2 * | 7/2012 | Ito | 399/405 |
| 8,430,399 | B1 * | 4/2013 | Huang et al. | 271/171 |
| 2005/0140086 | A1 * | 6/2005 | Ono et al. | 271/207 |
| 2006/0220303 | A1 * | 10/2006 | Lee et al. | 271/207 |
| 2008/0273908 | A1 | 11/2008 | Ohkubo et al. | |
| 2011/0024966 | A1 | 2/2011 | Fujii et al. | |
| 2011/0285077 | A1 * | 11/2011 | Otani et al. | 271/213 |
| 2013/0044174 | A1 * | 2/2013 | Takemura et al. | 347/108 |

FOREIGN PATENT DOCUMENTS

| | | |
|---|---|---|
| JP | 2004-256288 | 9/2004 |
| JP | 2007-176693 | 7/2007 |

* cited by examiner

PAPER OUTPUT TRAY, PAPER OUTPUT UNIT INCORPORATING SAME, AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2012-226860, filed on Oct. 12, 2012 in the Japan Patent Office, the entire disclosure of which is hereby incorporated by reference herein.

BACKGROUND

1. Technical Field

Embodiments of the present invention relate to a paper output tray that stocks output recording media, a paper output unit incorporating the paper output tray, and an image forming apparatus incorporating the paper output unit including the paper output tray.

2. Related Art

According to a reduction in size of an image forming apparatus such as a copier, a printer, a facsimile machine, or a multifunctional device including the features of the copier, the printer, and the facsimile machine, a paper output tray becomes more compact. It is known that such a compact paper output tray is equipped with a paper support extension that can be extended and retracted with respect to the paper output tray so that the compact paper output tray can stack a large recording medium thereon.

In addition to the above-described paper support extension, some paper output trays are provided with a stopper disposed close to the leading edge thereof to stop a recording medium conveyed to the paper output tray after image formation. The stopper prevents a subsequent recording medium to be output to the paper output tray from pushing a preceding recording medium stacked on the paper output tray off the paper output tray.

For example, an image forming apparatus disclosed in Japanese Patent Application Publication No. JP-2007-176693-A includes a paper stopper (i.e., a recording material locking body) swingably disposed at an edge part of an auxiliary paper tray (i.e., an auxiliary loading means) that is drawably/storably arranged with respect to a fixed paper output tray (i.e., a body loading means). By drawing the auxiliary paper tray from the fixed paper output tray, the paper stopper swings and stands up due to a biasing force exerted by a torsion spring. Therefore, a paper conveyed to the fixed paper output tray can be prevented from falling therefrom. The paper stopper is folded when storing the auxiliary paper tray in the fixed paper output tray. Accordingly, the paper stopper can be stored in the fixed paper output tray together with the auxiliary paper tray.

However, with the configuration in which the paper stopper is stored in the fixed paper output tray as disclosed in JP-2007-176693-A, when drawing or storing the auxiliary paper tray with respect to the fixed paper output tray, the paper stopper is slidably movable with respect to the fixed paper output tray. Therefore, it is likely that the paper stopper and/or the fixed paper output tray are damaged or broken.

SUMMARY

The present invention provides a paper output tray including a tray body to which a sheet material is output, a paper support extension slidably attached to the tray body and arranged switchable between a stored state in which the paper support extension is stored in an inner surface of the tray body in a storing direction and an extended state in which the paper support extension is pulled out to extend from the inner surface of the tray body in a sheet output direction, and a stopper rotatably attached to the paper support extension and arranged switchable between a folded state in which the stopper is folded to the paper support extension along the sheet output direction and a standing state in which the stopper is raised from the paper support extension in a sheet accumulation direction. With the paper support extension in the stored state and the stopper in the folded state, the stopper overlaps an outer surface of the tray body.

Further, the present invention provides a paper output unit including a sheet discharging unit to discharge a sheet material outside an image forming apparatus, and the above-described paper output tray.

Further, the present invention provides an image forming apparatus including a sheet feeding body to feed a sheet material, an image forming unit to form an image supplied thereto by the sheet feeding body, and the above-described paper output unit.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
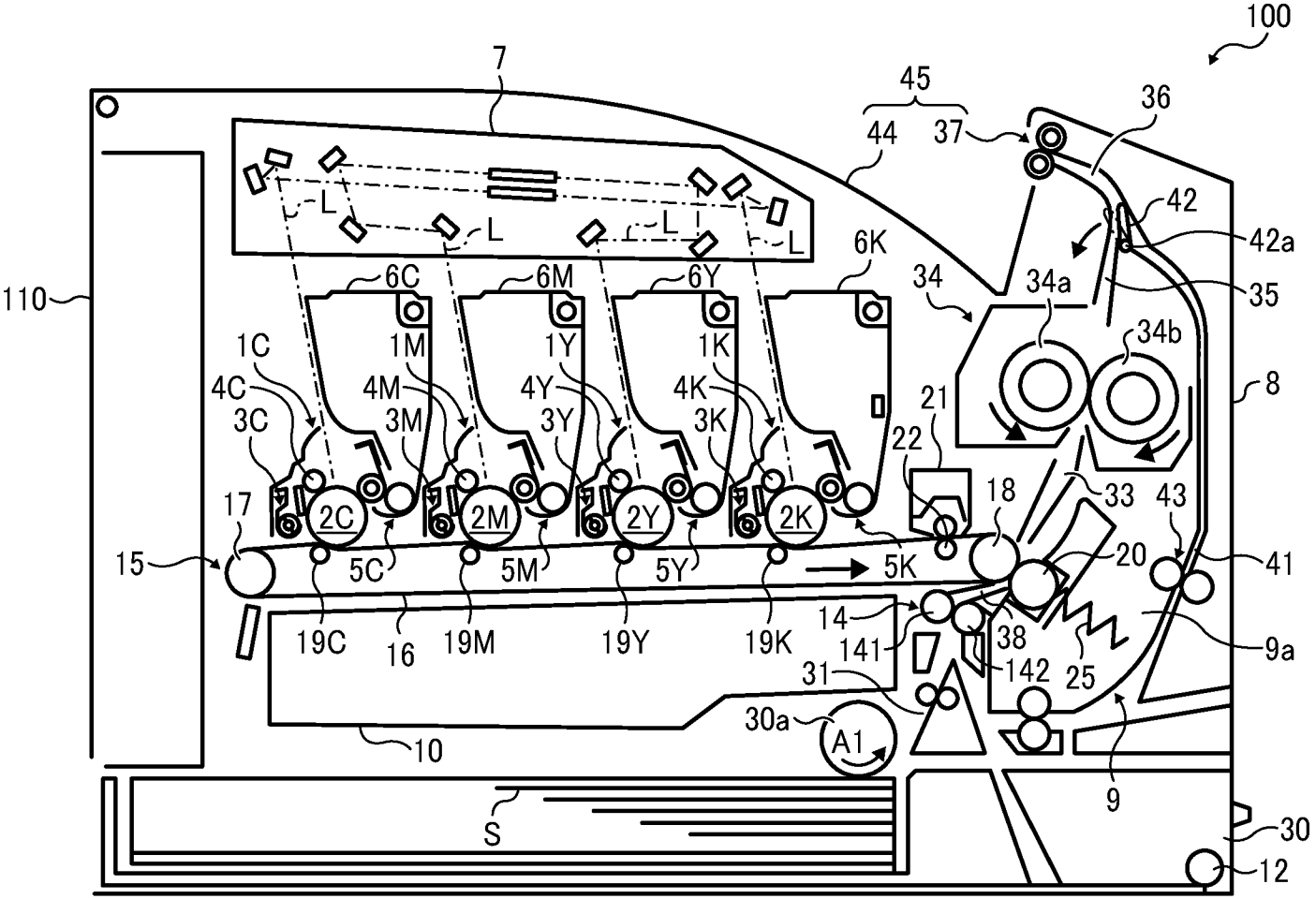
FIG. 1 is a vertical sectional view showing a schematic configuration of an image forming apparatus according to an embodiment of the present invention illustrating a paper output unit including a paper output tray.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Descriptions are given of an embodiment applicable to a paper output tray, a paper output unit incorporating the paper output tray, and an image forming apparatus incorporating the paper output unit with the paper output tray.

It is to be noted in the following embodiments that: the term "image forming apparatus" indicates an apparatus in which an image is formed on a medium such as paper, OHP (overhead projector) transparencies, OHP film sheets, thread, fiber, fabric, leather, metal, plastic, glass, wood, and/or ceramic by attracting developer or ink thereto; the term "image formation" indicates an action for providing (i.e., printing) not only an image having meanings such as texts and figures on a recordable medium but also an image having no meaning such as patterns on a medium on a medium; and the term "sheet material" is not limited to indicate a paper material but also includes the above-described plastic material (e.g., an OHP sheet), a fabric sheet and so forth, and is used as a general term of a recorded medium, recording medium, recording sheet, and recording material to which the developer or ink is attracted. In the following embodiments, the term "sheet material" is referred to as a "sheet". Size (dimension), material, shape, and relative positions used to describe each components and units are examples, and the scope of the invention is not limited thereto unless otherwise specified.

Figure 2:
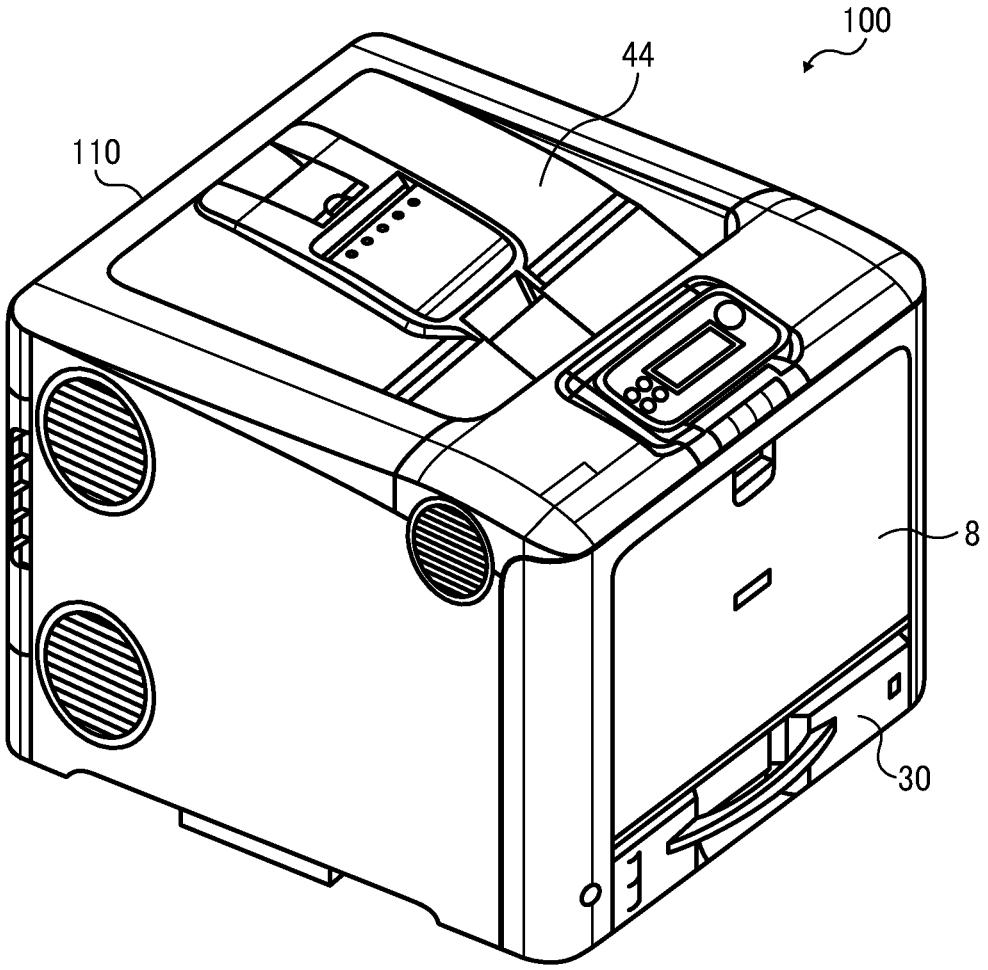
FIG. 2 is a perspective view illustrating an external appearance of the image forming apparatus of FIG. 1.
Figure 3:
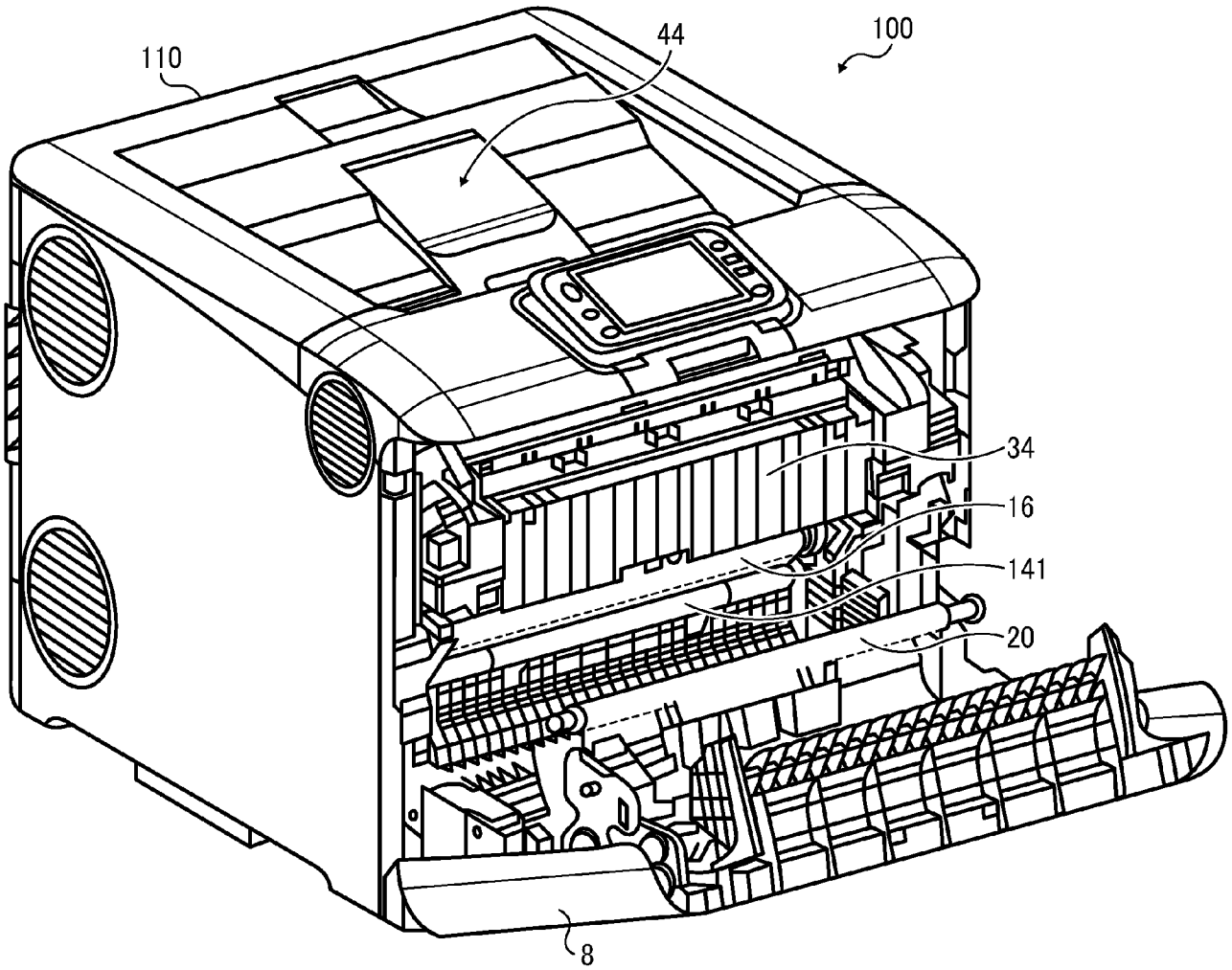
FIG. 3 is a perspective view illustrating the external appearance of the image forming apparatus of FIG. 1 with a front cover left open.

Referring to FIGS. 1 through 3, a description is given of a configuration of an image forming apparatus 100 according to an embodiment of the present invention. In an embodiment described with FIGS. 1 through 3, the image forming apparatus 100 is a laser printer. Alternatively, the image forming apparatus 100 may be a copier, a printer, a facsimile machine, or a multifunctional machine having at least two functions of the copier, the printer, and the facsimile machine, and can incorporate to a paper output tray 44 and a paper output unit 45 including the paper output tray 44 according to the present embodiment.

FIG. 1 is a vertical sectional view illustrating a schematic configuration of the image forming apparatus 100. FIG. 2 is a perspective view illustrating an external appearance of the image forming apparatus 100. FIG. 3 is a perspective view illustrating the external appearance of the image forming apparatus 100 with a front cover unit 8 left open.

As illustrated in FIGS. 2 and 3, the image forming apparatus 100 includes a main body 110, a sheet feeding tray 30, the front cover unit 8, and the paper output tray 44.

The main body 110 includes a plurality of units and components used for image formation. Details of the units and components will be described later.

The sheet feeding tray 30 is disposed at the lower part of the image forming apparatus 100.

The front cover unit 8 is disposed above the sheet feeding tray 30 and on an outside surface of the image forming apparatus 100 to function as a cover for opening and closing when checking the inside of the image forming apparatus 100.

The paper output tray 44 is formed at the upper portion of the image forming apparatus 100.

As illustrated in FIG. 1, the front cover unit 8 includes a duplex unit 9 on the inner surface thereof. The front cover unit 8 rotates about a rotary shaft 12 disposed at the lower part of the image forming apparatus 100. As the front cover unit 8 rotates about the rotary shaft 12, the front cover unit 8 moves to open to show an inner portion of the front side of the image forming apparatus 100 as illustrated in FIG. 3.

The duplex unit 9 includes a conveyance housing 9*a*, and a sheet switchback path 41 is defined by an inner surface of the front cover unit 8 and an outer surface of the conveyance housing 9*a*. The conveyance housing 9*a* includes a secondary transfer roller 20 that functions as a transfer member and a timing drive roller 142. The timing drive roller 142 and a timing driven roller 141 that is provided in the main body 110 of the image forming apparatus 100 form a timing roller pair 14. A sheet conveyance path 38 is defined by an inner surface of the conveyance housing 9*a* of the duplex unit 9 and extends from the timing roller pair 14 to a secondary transfer nip formed between the secondary transfer roller 20 and a drive roller 18 provided in the main body 110 of the image forming apparatus 100 to convey a sheet S.

With reference to FIG. 1, a description is given of a detailed configuration of the image forming apparatus 100.

As illustrated in FIG. 1, the main body 110 of the image forming apparatus 100 includes four process units 1K, 1Y, 1M, and 1C that function as image forming units for forming images according to respective single color developers (i.e., black, yellow, magenta, and cyan) corresponding to color separation of a color image.

The process units 1K, 1Y, 1M, and 1C are disposed in the main body 110 of the image forming apparatus 100, and have respective toner bottles 6K, 6Y, 6M, and 6C for containing unused toners of colors different from each other. The process units 1K, 1Y, 1M, and 1C have the same structure, differing only in the colors of toners in the toner bottles 6K, 6Y, 6M, and 6C.

The process units 1K, 1Y, 1M, and 1C further include photoconductor drums 2K, 2Y, 2M, and 2C functioning as image carriers, drum cleaning units 3K, 3Y, 3M, and 3C, non-illustrated electricity discharging units, charging units 4K, 4Y, 4M, and 4C, and developing units 5K, 5Y, 5M, and 5C, respectively. The process units 1K, 1Y, 1M, and 1C are detachably attachable to the main body 110 of the image forming apparatus 100, and consumable parts can be replaced at one time.

The main body 110 further includes an optical writing device 7, a transfer device 15, a fixing unit 34, and a powder container 10.

The optical writing device 7 is disposed above the process units 1K, 1Y, 1M, and 1C. The optical writing device 7 is configured to emit laser light beams L from laser diodes disposed therein based on image data.

The transfer device 15 is disposed below the process units 1K, 1Y, 1M, and 1C. The transfer device 15 includes four primary transfer rollers 19K, 19Y, 19M, and 19C, an intermediate transfer belt 16, the secondary transfer roller 20, a belt cleaning unit 21, and a cleaning backup roller 22.

The primary transfer rollers 19K, 19Y, 19M, and 19C are disposed facing the photoconductor drums 2K, 2Y, 2M, and 2C, respectively. The intermediate transfer belt 16 is an endless belt that is spanned over the primary transfer rollers 19K, 19Y, 19M, and 19C, the drive roller 18, and a driven roller 17. The secondary transfer roller 20 that functions as a secondary transfer unit is disposed facing the drive roller 18 to form the secondary transfer nip therebetween. The photoconductor drums 2K, 2Y, 2M, and 2C are defined as first image carriers, and the intermediate transfer belt 16 may be a second image carrier that carries a composite image thereon.

As described above, the sheet feeding tray 30 that can contain multiple sheets including the sheet S is disposed at the lower part of the image forming apparatus 100. A sheet feeding roller 30*a* functioning as a sheet feeding body is disposed above a right side of the sheet feeding tray 30 in FIG. 1. The sheet S is fed from the sheet feeding tray 30 toward a sheet feeding path 31 to convey the sheet S picked up from the sheet feeding tray 30 to the timing roller pair 14. The sheet feeding path 31 extends from the sheet feeding roller 30*a* to the timing roller pair 14.

The timing roller pair 14 is disposed around the downstream end of the sheet feeding path 31 and immediately upstream from the intermediate transfer belt 16 to stop the sheet S there temporarily. To cause a toner image formed on the intermediate transfer belt 16 to meet the leading edge of the sheet S at a proper position, the sheet S is sagged at the pair of timing rollers 32 once, and is then fed to a secondary transfer nip formed between the secondary transfer roller 20 and the drive roller 18 at a predetermined timing immediately before a toner image formed on the intermediate transfer belt 16 is transferred onto the sheet S at the secondary transfer nip portion formed between the secondary transfer roller 20 and the drive roller 18.

The secondary transfer roller 20 is generally tensioned by a compression spring 25 to the intermediate transfer belt 16. However, in the image forming apparatus 100 of a full-front access type, the duplex unit 9 is generally disposed before the intermediate transfer belt 16 and closer to the front cover, which makes it difficult to reduce the size of the area around the compression spring 25. Therefore, the secondary transfer nip portion formed between the secondary transfer roller 20 and the drive roller 18 is arranged in an oblique direction, as illustrated in FIG. 1. Consequently, dead space in the duplex unit 9 can be used effectively. As a result, a reduction in space in a front-to-back direction of the image forming apparatus 100 can be achieved.

A post-transfer sheet conveyance path 33 is disposed above the secondary transfer nip formed between the secondary transfer roller 20 and the drive roller 18 and extends from the secondary transfer nip to a fixing nip formed between a fixing roller 34*a* and a pressure roller 34*b* included in the fixing unit 34.

The fixing unit 34 is disposed in the vicinity of the fixing nip, which is a downstream end of the post-transfer sheet conveyance path 33. The fixing roller 34*a* includes a heating source such as a non-illustrated halogen lamp. The pressure roller 34*b* rotates while contacting the fixing roller 34*a* with a given pressure.

A post-fixing sheet conveyance path 35 extends from the fixing unit 34 downstream in a sheet conveying direction. The post-fixing sheet conveyance path 35 branches at the downstream end thereof into two paths, which are a sheet discharging path 36 and the switch-back conveyance path 41. A switching member 42 is disposed at the downstream end of the post-fixing sheet conveyance path 35 on a side of the switch-back conveyance path 41. The switching member 42 rotates about a swing shaft 42*a* for switching the conveyance direction of the sheet S. A sheet discharging roller pair 37 is disposed at a downstream end of the sheet discharging path 36. The sheet discharging roller pair 37 functions as a sheet discharging unit to discharge the sheet S outside the main body 110 of the image forming apparatus 100. The switchback conveyance path 41 meets the sheet feeding path 31 extending from the sheet feeding roller 30*a* to the timing roller pair 14 at the downstream end thereof. A switch-back conveyance roller pair 43 is disposed in the middle of the switch-back conveyance path 41. Further, the paper output tray 44 is formed on top of the main body 110 of the image forming apparatus 100. The paper output tray 44 includes a top cover recessed inwardly.

The powder container 10 (i.e., a toner container) is disposed between the transfer device 15 and the sheet feeding tray 30 to contain waste toner therein. The powder container 10 is detachably attachable to the main body 110 of the image forming apparatus 100.

In the image forming apparatus 100 according to the present embodiment, it is designed that the sheet feeding roller 30*a* is separated from the secondary transfer roller 20 by a certain distance or gap due to conveyance of a transfer sheet such as the sheet S. This separation generates dead space or unused space. By disposing the powder container 10 in the dead space, a reduction in overall size of the image forming apparatus 100 is achieved.

Next, a description is given of basic image forming operations of the image forming apparatus 100 according to an embodiment.

As shown in FIG. 1, a non-illustrated controller provided to the image forming apparatus 100 issues sheet feeding signals. In response to the sheet feeding signals, the controller causes the sheet feeding roller 30*a* to rotate in a direction indicated by arrow A1 in FIG. 1. As the sheet feeding roller 30*a* starts to rotate in the direction A1, the sheet S placed on top of a stack of sheets in the sheet feeding tray 30 is separated from the other sheets accommodated in the sheet feeding tray 30 to be fed toward the sheet feeding path 31. When the leading edge of the sheet S reaches the nip of the timing roller pair 14, the sheet S stands by while being sagged so that skew at the leading edge of the sheet S is calibrated and that movement of the sheet S is synchronized with movement of a toner image formed on the intermediate transfer belt 16.

For example, in basic image forming operations of the process unit 1K, the charging unit 4K uniformly charges a surface of the photoconductor drum 2K by supplying a high electric potential at the surface of the photoconductor drum 2K. Based on image data, the laser light beam L is emitted from the optical writing device 7 to the charged surface of the photoconductor drum 2K, so that the electric potential at the emitted portion on the surface of the photoconductor drum 2K decreases to form an electrostatic latent image. The toner bottle 6K supplies the unused black toner to the developing unit 5K.

The developing unit 5K supplies the black toner to the electrostatic latent image formed on the surface of the photoconductor drum 2K to develop the electrostatic latent image into a visible black toner image. Then, the toner image formed on the surface of the photoconductor drum 2K is transferred onto a surface of the intermediate transfer belt 16.

The drum cleaning unit 3K removes residual toner remaining on the surface of the photoconductor drum 2K after an intermediate transfer operation. The removed residual toner is conveyed by a non-illustrated waste toner conveyance unit and collected to a waste toner collecting unit included in the process unit 1K. The electricity discharging unit removes residual electric potential remaining on the surface of the photoconductor drum 2K after cleaning.

Even though the above description details operations in the process unit 1K, the same operation is performed in the other process units 1Y, 1M, and 1C. For example, respective toner images are developed on the respective surfaces of the photoconductor drums 2Y, 2M, and 2C and are then sequentially transferred onto the surface of the intermediate transfer belt 16 to form a composite color image.

After the respective color toner images are transferred sequentially onto the surface of the intermediate transfer belt 16 to form a composite toner image, the timing roller pair 14 and the sheet feeding roller 30*a* start driving to convey the sheet S to the secondary transfer roller 20 in synchronization with movement of the toner image formed on the surface of the intermediate transfer belt 16. Then, the composite toner image formed on the surface of the intermediate transfer belt 16 is transferred onto the sheet S conveyed as above at the secondary transfer nip formed between the drive roller 18 and the secondary transfer roller 20 with the intermediate transfer belt 16 interposed therebetween.

The sheet S on which the transferred toner image is formed passes through the post-transfer sheet conveyance path 33 to the fixing unit 34. In the fixing unit 34, the sheet S passes between the fixing roller 34*a* and the pressure roller 34*b*. Thus, the unfixed toner image on the sheet S is fixed to the sheet S by application of heat and pressure. The sheet S with the fixed image thereon is conveyed from the fixing unit 34 to the post-fixing sheet conveyance path 35.

At the feeding of the sheet S from the fixing unit 34, the switching member 42 is at a position as illustrated by a solid line in FIG. 1 to allow passage of the sheet S around the end of the post-fixing sheet conveyance path 35. After traveling from the fixing unit 34 through the post-fixing sheet conveyance path 35, the sheet S is sandwiched by and passes through the output roller pair 37, and is discharged to the paper output tray 44.

When performing a duplex printing, as the trailing edge of the sheet S conveyed by the output roller pair 37 passes through the post-fixing sheet conveyance path 35, the switching member 42 rotates to a position indicated by a dotted line in FIG. 1 to block the passage of the sheet S at the end of the post-fixing sheet conveyance path 35. Substantially simultaneously, the output roller pair 37 rotates in reverse to feed the sheet S in an opposite direction to the switchback conveyance path 41.

The sheet S conveyed in the switchback conveyance path 41 passes through the pair of switch-back conveyance rollers 43 and reaches the timing roller pair 14. The sheet S is fed in synchronization with another toner image formed on the surface of the intermediate transfer roller 16 for printing the toner image on a reverse side of the sheet S. When the sheet S passes through the secondary transfer nip formed between the drive roller 18 and the secondary transfer roller 20 with the intermediate transfer belt 16 interposed therebetween, the toner image is formed on the reverse side of the sheet S. Then, after the toner image formed on the reverse side of the sheet S is fixed by the fixing unit 34 to the sheet S, the sheet S travels through the post-fixing sheet conveyance path 35, the sheet discharging path 36, and the pair of sheet feeding rollers 37 to be discharged to the sheet discharging tray 44.

Further, even after the toner image formed on the surface of the intermediate transfer belt 16 has been transferred onto the sheet S, residual toner remains on the surface of the intermediate transfer belt 16. Such residual toner is removed by the belt cleaning unit 21 from the intermediate transfer belt 16.

The residual toner removed from the intermediate transfer belt 16 is conveyed by a non-illustrated waste toner conveyance unit to the powder container 10 and collected through an entrance of the powder container 10.

Figure 4:
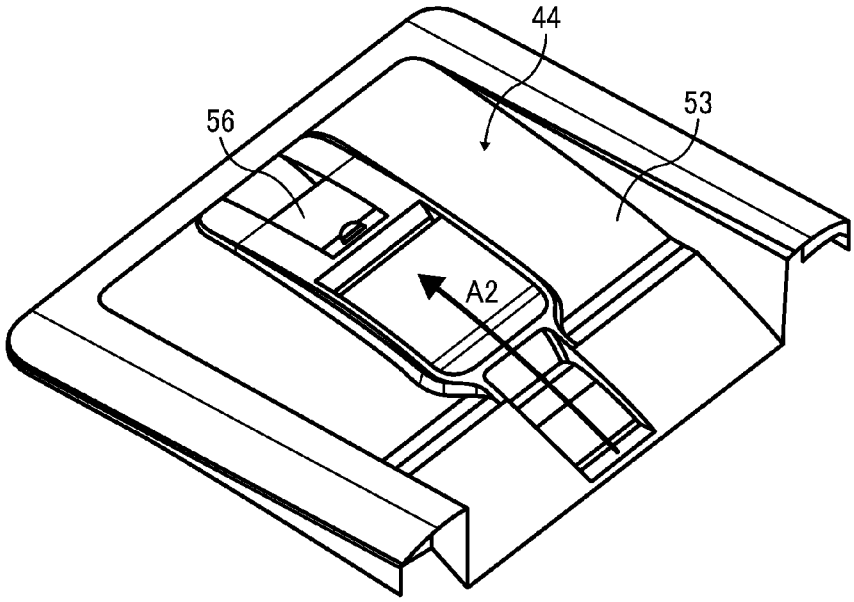
FIG. 4 is a perspective view illustrating the paper output tray according to an embodiment.
Figure 5:
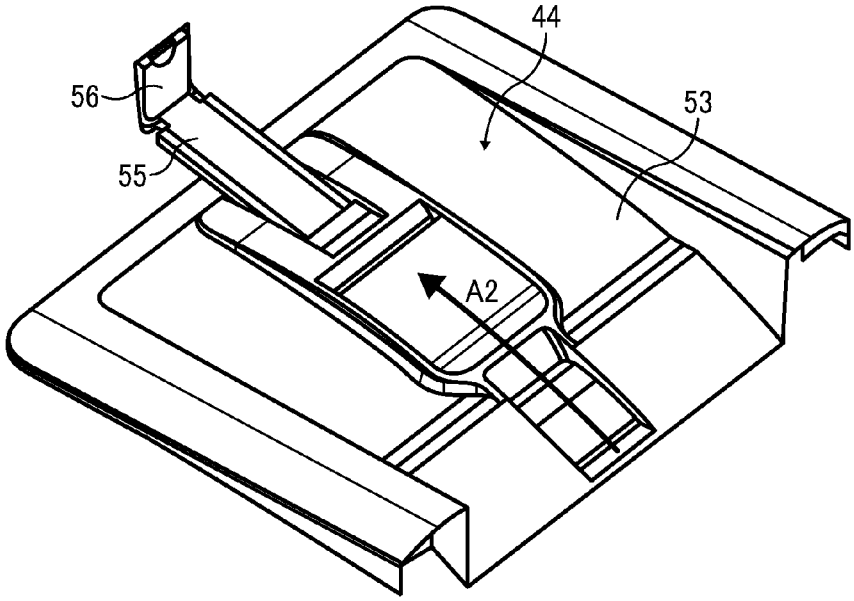
FIG. 5 is a perspective view illustrating the paper output tray of FIG. 4 with a paper support extension extended and a stopper unfolded.

With reference to FIGS. 4 and 5, a description is given of a configuration of the paper output tray 44.

FIG. 4 is a perspective view illustrating the paper output tray 44. FIG. 5 is a perspective view illustrating the paper output tray 44 with a paper support extension 55 extended and a stopper 56 unfolded and standing at a free end of the paper support extension 55.

The paper output tray 44 is disposed atop the image forming apparatus 100 and includes a paper tray body 53, the paper support extension 55, and the stopper 56. The paper tray body 53 is integrally attached to a top cover of the image forming apparatus 100. The paper support extension 55 is attached to the paper tray body 53. The stopper 56 is rotatably attached to the paper support extension 55.

After image formation and image transfer onto the sheet S have been completed, the sheet S is conveyed and discharged by the output roller pair 37 to the paper output tray 44.

As illustrated in FIG. 5, the paper support extension 55 is pulled out from the paper tray body 53 in a sheet output direction indicated by arrow A2. The paper support extension 55 allows a large sheet to be loaded on the paper tray body 53 without falling off the image forming apparatus 100.

The stopper 56 stands upwardly at the free end of the paper support extension 55 in a sheet stacking direction that is indicted by arrow A3. The free end of the paper support extension 55 is disposed downstream from an opposing end of the paper support extension 55 in the sheet output direction A2. The stopper 56 regulates a position of the leading edge of the sheet S discharged by the output roller pair 37 to the paper output tray 44. Consequently, a preceding sheet is prevented from being pushed off the image forming apparatus 100 by a subsequent sheet discharged by the output roller pair 37 after the preceding sheet.

With reference to FIGS. 6 through 10, a detailed description is given of the paper output tray 44.

Figure 6:
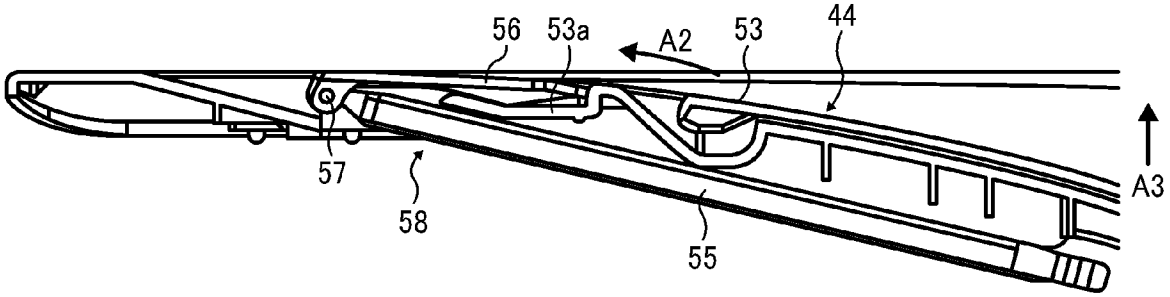
FIG. 6 is a vertical sectional view illustrating the paper output tray of FIG. 4.
Figure 7:
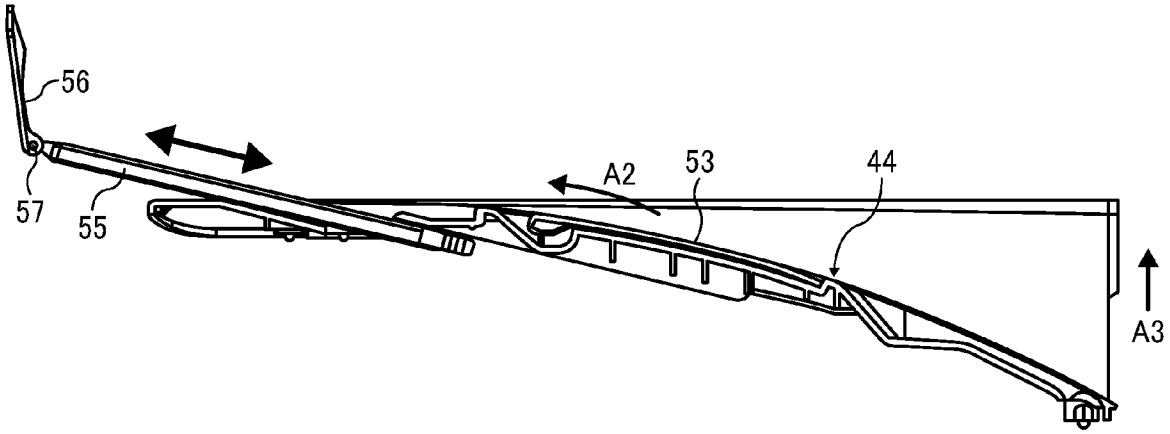
FIG. 7 is a vertical sectional view illustrating the paper output tray of FIG. 4 with paper support extension extended and the stopper standing.
Figure 8:
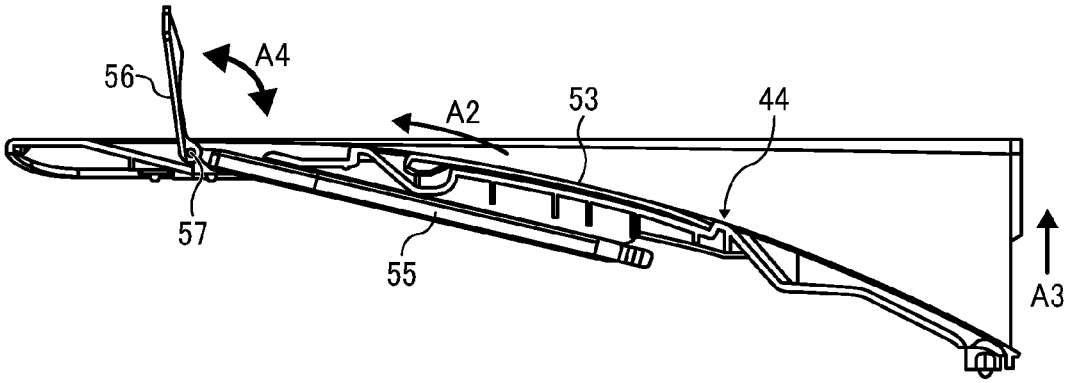
FIG. 8 is a vertical sectional view illustrating the paper output tray of FIG. 4 with the stopper standing.

FIG. 6 is a vertical sectional view illustrating the paper output tray 44. FIG. 7 is a vertical sectional view illustrating the paper output tray 44 with the paper support extension 55 extended and the stopper 56 unfolded. FIG. 8 is a vertical sectional view illustrating the paper output tray 44 with the stopper 56 unfolded.

The paper support extension 55 is switchable between a stored state and an extended state. The stored state is illustrated in FIGS. 6 and 8, in which the paper support extension 55 is stored in space below an inner surface of the paper tray body 53. The extended state is illustrated in FIG. 7, in which the paper support extension 55 is extended from the space below the inner surface of the paper tray body 53 in the sheet output direction A2. FIG. 7 shows the paper support extension 55 that is extended fully or to the maximum. Alternatively, the paper support extension 55 can be extended to any position before the full extension length.

The paper output tray 44 further includes a shaft 57 at the leading edge of the paper support extension 55 in the paper output direction A2. The stopper 56 is disposed rotatable about the shaft 57. The stopper 56 is switchable between a folded state and a standing state. The folded state is illustrated in FIG. 6, in which the stopper 56 is folded over the paper support extension 55 along with the paper output direction A2. The standing state is illustrated in FIGS. 7 and 8, in which the stopper 56 stands upward in the sheet stacking direction A3. Alternatively, the stopper 56 may be switchable between the folded state and the standing state with a non-illustrated engaging member having a projection and/or a recess.

The paper tray body 53 includes an overlapped section 53*a* (see FIG. 9) that is formed on an outer (or upper) surface thereof.

As illustrated in FIG. 6, when the paper support extension 55 is in the stored state and the stopper 56 is in the folded state, the stopper 56 overlaps the overlapped section 53*a* of the outer surface of the paper tray body 53. An opening 58 is formed below the overlapped section 53*a* on which the stopper 56 overlaps. The paper support section 55 is stored through the opening 58.

Figure 9:
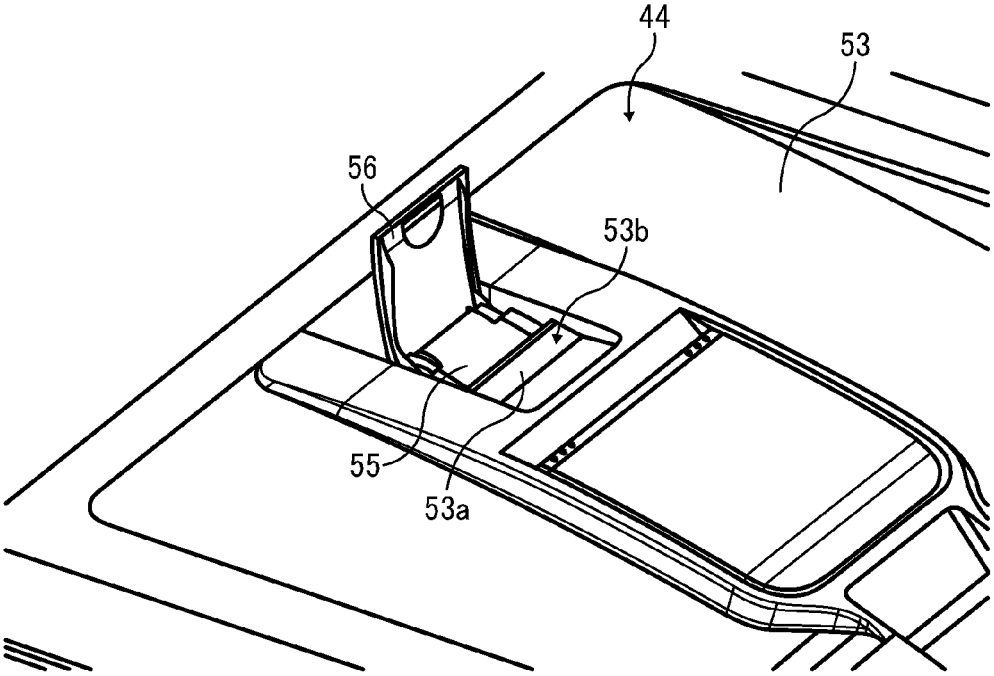
FIG. 9 is a perspective view illustrating a main section of the paper output tray with the stopper standing.
Figure 10:
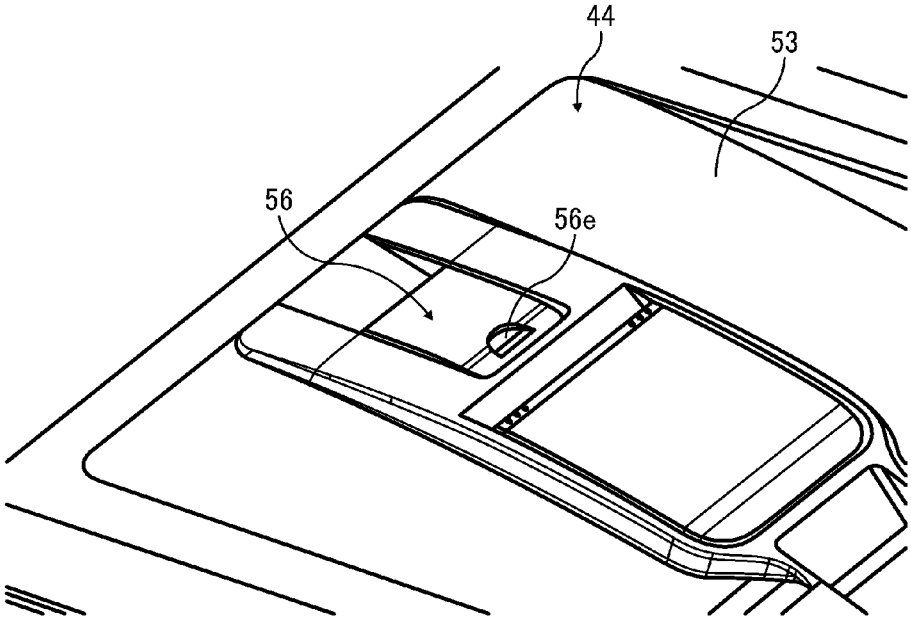
FIG. 10 is a perspective view illustrating a main section of the paper output tray with the stopper folded.

FIG. 9 is a perspective view illustrating a main section of the paper output tray 44 with the stopper 56 unfolded and standing. FIG. 10 is a perspective view illustrating the main section of the paper output tray 44 with the stopper 44 folded and stored in the space below the inner surface of the paper tray body 53.

As illustrated in FIG. 9, the paper tray body 53 further includes a recess 53*b*. The recess 53*b* is formed on the outer surface of the paper tray body 53 so as to store the stopper 56 therein in the folded state of the stopper 56. As illustrated in FIG. 10, if the paper support extension 55 is in the stored state and the stopper 56 in the folded state, the stopper 56 is stored in the recess 53*b*. Under these states, an upper surface of the stopper 56, which is an opposing surface facing a surface of the stopper 56 that faces the paper support extension 55 forms the substantially same surface as the outer surface of the paper tray body 53. The upper surface of the stopper 56 is provided with a finger pull handle 56*e*. The finger pull handle 56*e* has a recessed portion to which a user insert and hook his/her finger to hook and open the stopper 56 to change to the standing state or to extend the paper support extension 55.

With reference to FIGS. 11 through 14, a detailed description is given of the paper output tray 44.

Figure 11:
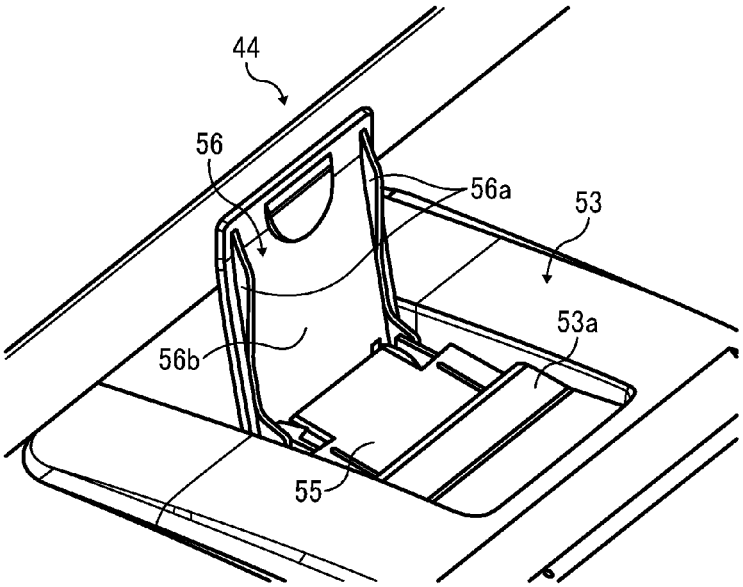
FIG. 11 is an enlarged perspective view illustrating a main section of the paper output tray with the stopper standing.
Figure 12:
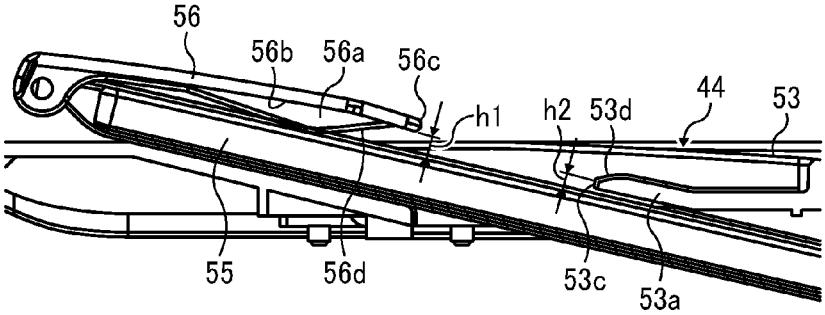
FIG. 12 is an enlarged vertical sectional view illustrating a main section of the paper output tray with the paper support extension extended and the stopper folded.
Figure 13:
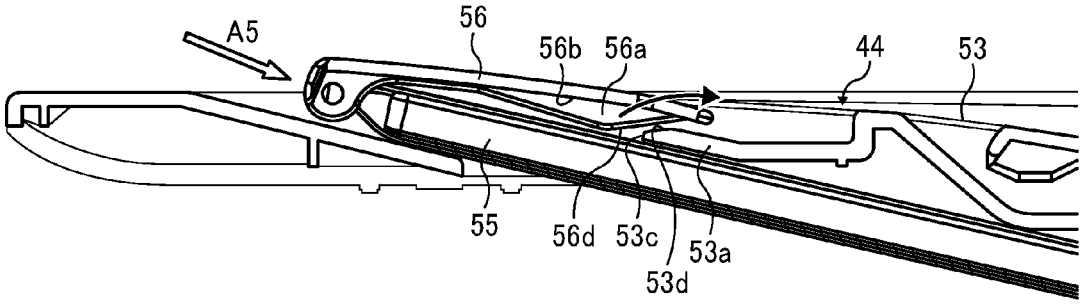
FIG. 13 is an enlarged vertical sectional view illustrating the main section of the paper output tray with the paper support extension slidably pulled down.
Figure 14:
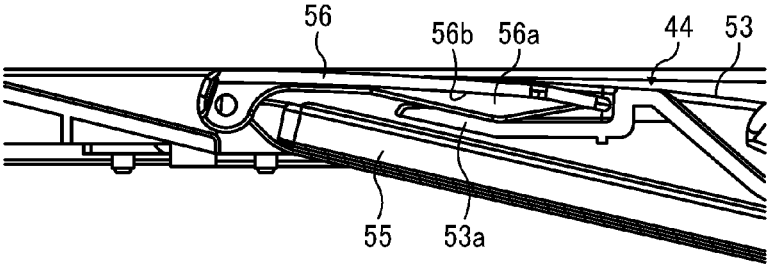
FIG. 14 is an enlarged vertical sectional view illustrating the main section of the paper output tray with the paper support extension stored.

FIG. 11 is an enlarged perspective view illustrating the main section of the paper output tray 44 with the stopper 56 unfolded and standing. FIG. 12 is an enlarged vertical sectional view illustrating the main section of the paper output tray 44 with the paper support extension 55 extended and the stopper 56 folded. FIG. 13 is an enlarged vertical sectional view illustrating the main section of the paper output tray 44 with the paper support extension 55 slidably pushed down. FIG. 14 is an enlarged vertical sectional view illustrating the main section of the paper output tray 44 with the paper support extension 55 retracted to and stored at a home position.

As illustrated in FIG. 11, the stopper 56 includes projections 56*a* and an opposing surface 56*b*. The projections 56*a* are provided at opposed ends on the opposing surface 56*b* of the stopper 56 in a lateral direction with respect to the sheet output direction A2. The opposing surface 56*b* faces an upper surface of the paper support extension 55 or the outer surface of the paper tray body 53 when the stopper 56 is in the folded state. The projections 56*a* in the present embodiment are formed in the shape of a rib extending along a storing direction of the paper support extension 55 as indicated by arrow A5 in FIG. 13, with the stopper 56 in the folded state.

As illustrated in FIGS. 12 through 14, when the stopper 56 is in the folded state, the projections 56*a* contact the upper surface of the paper support extension 55 or the outer surface of the paper tray body 53. Accordingly, the opposing surface 56*b* of the stopper 56 is supported separated from the paper support extension 55 or the paper tray body 53.

The stopper 56 further includes a tip end 56*c* that is a leading end thereof in a rotational moving direction A4 for folding or unfolding the stopper 56 as well as the storing direction A5 of the paper support extension 55 with the stopper in the folded state. The paper tray body 53 further includes an edge part 53*c* on the overlapped section 53*a*. The edge part 53*c* is disposed opposite the tip end 56*c* of the stopper 56 in the sheet output direction A2.

FIG. 12 shows the state that the paper support extension 55 is extended and that the stopper 56 is folded and stored in the paper support extension 55. A height from the upper surface of the paper support extension 55 to a surface of the tip end 56*c* that is the same side as the opposing surface 56*b* of the stopper 56 and that faces the upper surface of the paper support extension 55 is denoted as "h1" and another height from the upper surface of the paper support extension 55 to the edge part 53*c* of the overlapped section 53*a* of the paper tray body 53 facing the upper surface of the paper support extension 55 is denoted as "h2". In the above-described state, the height of each projection 56*a* is adjusted such that the height h1 is greater than the height h2.

The stopper 56 further includes a sloped portion 56*d* on each of the projections 56*a* in the vicinity of the tip end 56*c* on the side of the opposing surface 56*b*. With the stopper 56 in the folded state, the sloped portion 56*d* is formed to incline or slope downwardly in a direction opposite the storing direction A5 (FIG. 13) of the paper support extension 55 toward the paper support extension 55 or the paper tray body 53.

The paper tray body 53 further includes a sloped portion 53*d* on the outer surface thereof, facing the tip end 56*c* of the stopper 56 in the sheet output direction A2 in the stored state of the paper support extension 55. The sloped portion 53*d* is formed to incline or slope in a direction opposite the storing direction A5 (FIG. 13) of the paper support extension 55, which is toward an upward side of the inner surface of the paper tray body 53.

Figure 15:
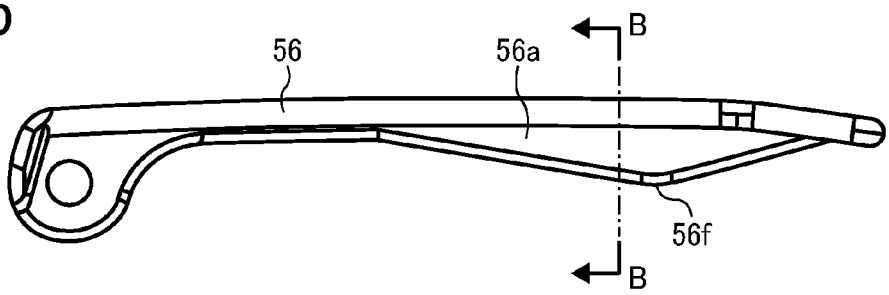
FIG. 15 is a side view illustrating the stopper.
Figure 16:
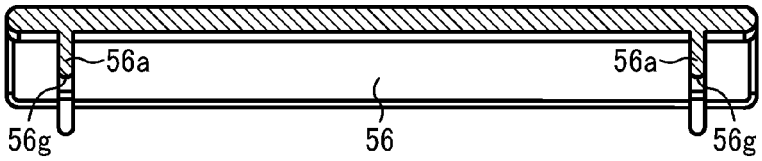
FIG. 16 is a vertical sectional view illustrating the stopper in a lateral direction along a line B-B of FIG. 15.

With reference to FIGS. 15 and 16, a detailed description is given of the stopper 56.

FIG. 15 is a side view illustrating the stopper 56. FIG. 16 is a vertical sectional view illustrating the stopper 56 in a lateral direction along a line B-B of FIG. 15.

As illustrated in FIG. 15, the stopper 56 further includes a top part 56*f* that is projected from each of the projections 56*a*. Viewing the stopper 56 from one lateral side thereof, the top part 56*f* and an adjacent area thereof are formed in a convex curvature shape. In other words, in the state the stopper is folded, the top part 56*f* and the adjacent area of each of the projections 56*a* are formed in a convex curvature shape over the storing direction of the paper support extension 55.

As illustrated in FIG. 16, edges 56*g* of the projections 56*a* are formed in a convex curvature shape in a lateral cross section throughout each of the projections 56*a*. That is, in the state the stopper 56 is folded, the edges 56*g* in the lateral cross section of the projections 56*a* are formed in a convex curvature shape over a lateral direction intersecting the storing direction of the paper support extension 55.

Next, a description is given of operations and functions of the paper output tray 44 according to the present embodiment.

When a paper to be printed out to the paper output tray 44 has a size that fits on the paper tray body 53, the printed paper is ejected to and stacked on the paper tray body 53 with the paper support extension 55 in the stored state and the stopper 56 in the folded state as illustrated in FIG. 6 or in the standing state as illustrated in FIG. 8. In the state that the stopper 56 is in the standing state, the printed paper conveyed to the paper tray body 53 of the paper output tray 44 can be prevented from being pushed by a subsequent printed paper to fail therefrom.

When a paper to be printed out to the paper output tray 44 has a size that is greater than the size of the paper tray body 53, the paper support extension 55 is pulled out from the paper tray body 53 to the extended state and the stopper 56 is unfolded to the standing state as illustrated in FIG. 7. By so doing, the entire length of the printed paper can fit the paper tray body 53 after it is ejected thereto. As a result, consistency of output papers can be maintained In a range that the paper support extension 55 is movable between the stored state and the extended state, the paper output tray 44 is formed to provide click feeling each time the paper support extension 55 reaches positions of respective standard paper sizes. With this structure, the position of the stopper 56 can be adjusted to an appropriate position of a desired paper size easily. This structure can be achieved with a detachable elastic member and an engaging member that engages the detachable elastic member by providing one of the detachable elastic member and the engaging member to the stopper 56 and the other to the paper tray body 53.

In the state that the paper support extension 55 is in the stored state and the stopper 56 is in the folded state as illustrated in FIG. 6, if the stopper 56 is moved to be rise or if the paper support extension 55 is moved to extend, a user place the finger at the finger pull handle 56*e* of the stopper 56 (see FIG. 10) to switch to a desired state easily.

In the state that the paper support extension 55 is in the extended state and the stopper 56 is in the standing state as illustrated in FIG. 7, if the paper support extension 55 is moved to be stored state and the stopper 56 is moved to be folded as illustrated in FIG. 6, the order of whether the paper support extension 55 is stored or the stopper 56 is folded does not affect the result.

For example, if the paper support extension 55 is stored first, the paper support extension 55 is pushed and inserted into the paper tray body 53 to the state as illustrated in FIG. 8. Then, the stopper 56 is rotated forward and folded to be stored in the recess 53*b* of the paper tray body 53 as illustrated in FIG. 9. In these states, the stopper 56 overlaps the overlapped section 53*a* of the paper tray body 53 and the projections 56*a* contacts an upper surface of the overlapped section 53*a*, as illustrated in FIG. 14. By so doing, the stopper 56 is supported without contacting the overlapped section 53*a*.

In the present embodiment, the stopper 56 can be stored in the recess 53*b* of the paper tray body 53, so that the image forming apparatus 100 can be downsized. Further, in the state that the stopper 56 is stored in the recess 53*b*, the upper surface of the stopper 56 is formed to the substantially same surface as the outer surface of the paper tray body 53. Therefore, the paper tray body 53 can form a loading surface with less unevenness. Accordingly, good consistency of output papers can be obtained and quality of outer appearance of the image forming apparatus 100 can be enhanced.

In the state that the stopper 56 is overlapped on the overlapped section 53*a* of the paper tray body 53, the stopper 56 is located such that a part of the opening 58 is blocked. Consequently, this can prevent foreign material from coming into the inside of the image forming apparatus 100 through the opening 58.

By contrast, if the stopper 56 is folded first, the paper support extension 55 is pushed and inserted into the paper tray body 53 to the state with the stopper 56 in the folded state as illustrated in FIG. 12. At this time, in the present embodiment, the height h1 from the upper surface of the paper support extension 55 to the surface of the tip end 56*c* that is the same side as the opposing surface 56*c* of the stopper 56 and that faces the upper surface of the paper support extension 55 is greater than the height h2 from the upper surface of the paper support extension 55 to the edge part 53*c* of the overlapped section 53*a* of the paper tray body 53 disposed opposite the tip end 56*c* and facing the upper surface of the paper support extension 55. Therefore, the tip end 56*c* of the stopper 56 in the sheet output direction A2 and the edge part 53*c* of the paper tray body 53 that faces the tip end 56*c* are formed such that the tip end 56*c* and the edge part 53*c* do not interfere with each other. As a result, scratch or damage caused by interference of the stopper 56 and the paper tray body 53 can be prevented.

If the paper support extension 55 is pushed further in the storing direction, the projections 56*a* contact the paper tray body 53 on the edge part 53*c* opposite the projections 56*a* in the storing direction of the paper support extension 55 as illustrated in FIG. 13. Then, as the paper support extension 55 moves in the storing direction thereof, the projections 56*a* slide toward the edge part 53*c* of the paper tray body 53 and runs on the paper tray body 53. Since the configuration of the paper output tray 44 includes the sloped portion 56*d* formed on the projections 56*a* on the side of the tip end 56*c* in the rotational moving direction A4 and the sloped portion 53*d* formed on the outer surface of the paper tray body 53 on the side of the edge part 53*c*, the stopper 56 can run on the paper tray body 53 smoothly. Specifically, each of the sloped portions 56*d* and 53*d* functions as a guide that guides the stopper 56 onto the paper tray body 53 smoothly.

After running on the paper tray body 53, the stopper 56 is stored in the recess 53*b* to overlap on the overlapped section 53*a*. In the state in which the stopper 56 overlaps the overlapped section 53*a*, the projections 56*a* contact the upper surface of the overlapped section 53*a*. Therefore, the stopper 56 is supported without contacting the overlapped section 53*a*.

As described above, the top part 56*f* of the projections 56*a* and the adjacent area are formed in a convex curvature shape as illustrated in FIG. 15. Therefore, each of the projections 56*a* is slidably movable smoothly without being caught by the paper tray body 53. As a result, operability of the image forming apparatus 100 can be enhanced. Further, if the top part 56*f* and the adjacent area is formed in a convex curvature shape, the degree in difficulty in manufacturing mechanical parts decreases and part accuracy increases. Consequently, in the state that the stopper 56 is stored in the recess 53*b* of the paper tray body 53, the level of the upper surface of the stopper 56 and the level of the outer surface the paper tray body 53 can be adjusted to the substantially same planar surface as each other easily. Accordingly, good consistency of output papers can be obtained and quality of outer appearance of the image forming apparatus 100 can be enhanced.

In the present embodiment, the edges 56*g* of the projections 56*a* are formed in a convex curvature shape in the lateral cross section of the projections 56*a* as illustrated in FIG. 16. Accordingly, a contact area in which the projections 56*a* slidably move on the paper tray body 53 is decreased, and therefore a frictional load of the projections 56*a* on the paper tray body 53 can be reduced. Consequently, the projections 56*a* can move smoothly. As a result, operability of the projections 56*a* can be enhanced.

It is to be noted that operations can be performed in a reverse order of the above-described operations. By so doing, from the state in which the paper support extension 55 is in the stored state and the stopper 56 is in the folded state, the paper support extension 55 can be extended before the stopper 56 is stood up or the stopper can be stood up before the paper support extension 55 is extended.

Figure 17:
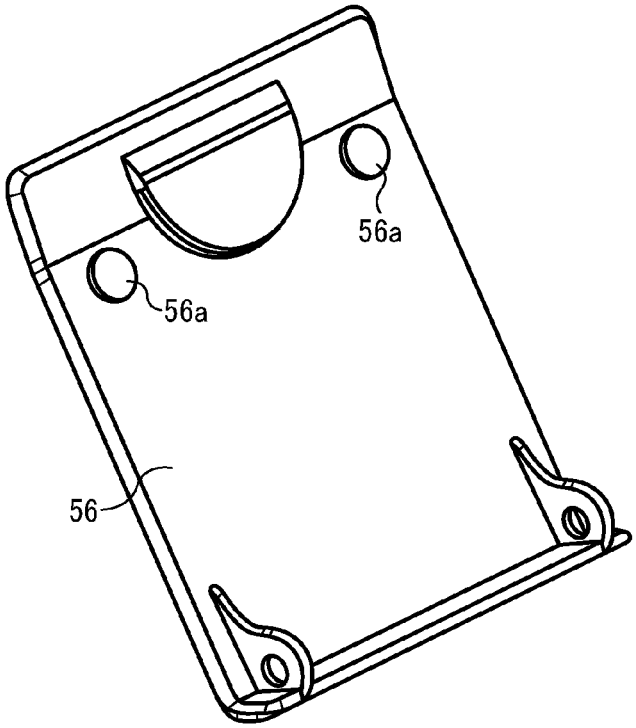
FIG. 17 is a perspective view illustrating a stopper according to another embodiment.
Figure 18:
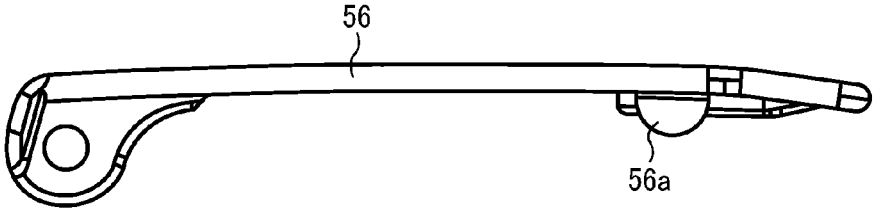
FIG. 18 is a side view illustrating the stopper of FIG. 17.
Figure 19:
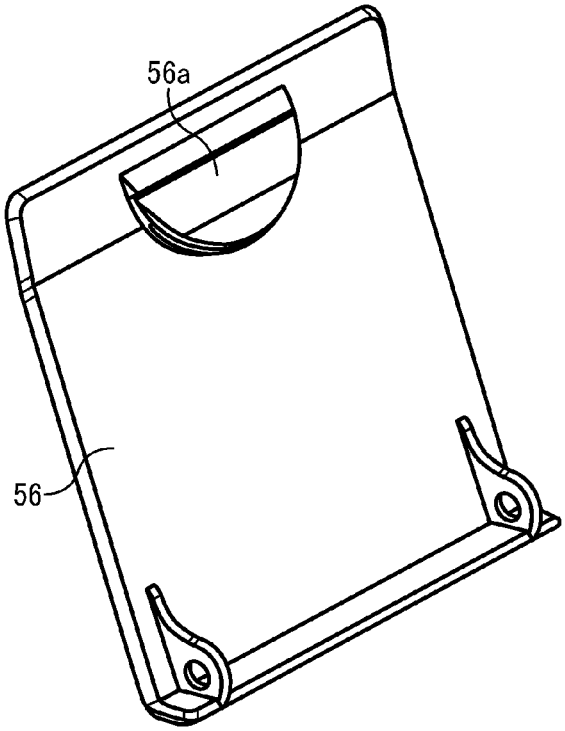
FIG. 19 is a perspective view illustrating a stopper according to yet another embodiment.
Figure 20:
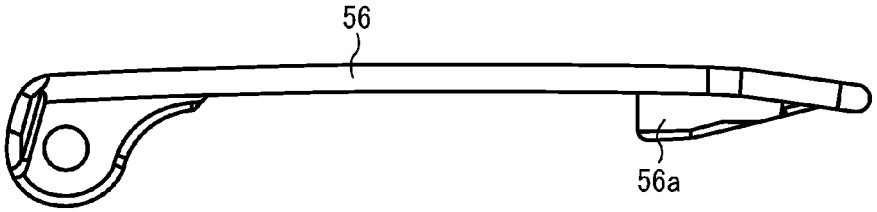
FIG. 20 is a side view illustrating the stopper of FIG. 19.

In the present embodiment, the projections 56*a* of the stopper 56 are rib shaped. However, the shape of the projections 56*a* is not limited thereto. For example, as illustrated in FIGS. 17 and 18, the projections 56*a* may be formed in a semispherical shape. Alternatively, as illustrated in FIGS. 19 and 20, the projections 56*a* may be formed in the shape of a protrusion or an outwardly and downwardly protruding part that is formed on a reverse side of the recessed finger pull handle 56*e* of the stopper 56 that is opposite the upper surface of the stopper 56 facing the paper support extension 55 to provide a given thickness of the recessed finger pull handle 56*e*.

Figure 21:
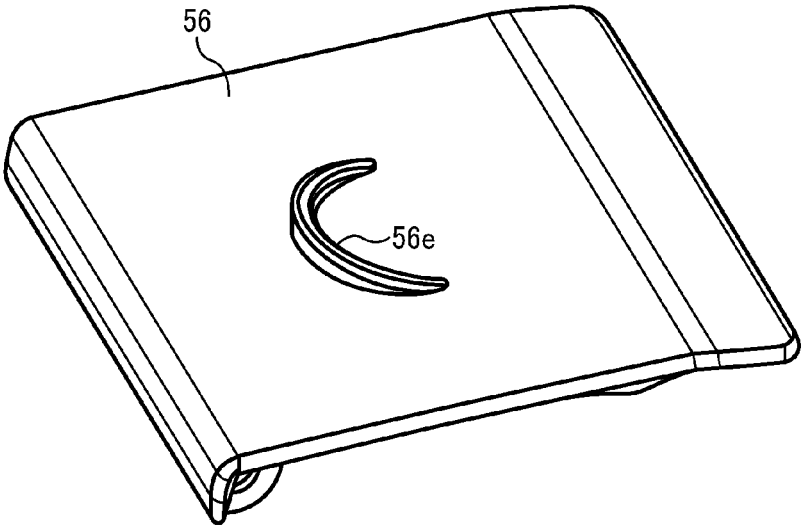
FIG. 21 is a perspective view illustrating a stopper according to yet another embodiment.
Figure 22:
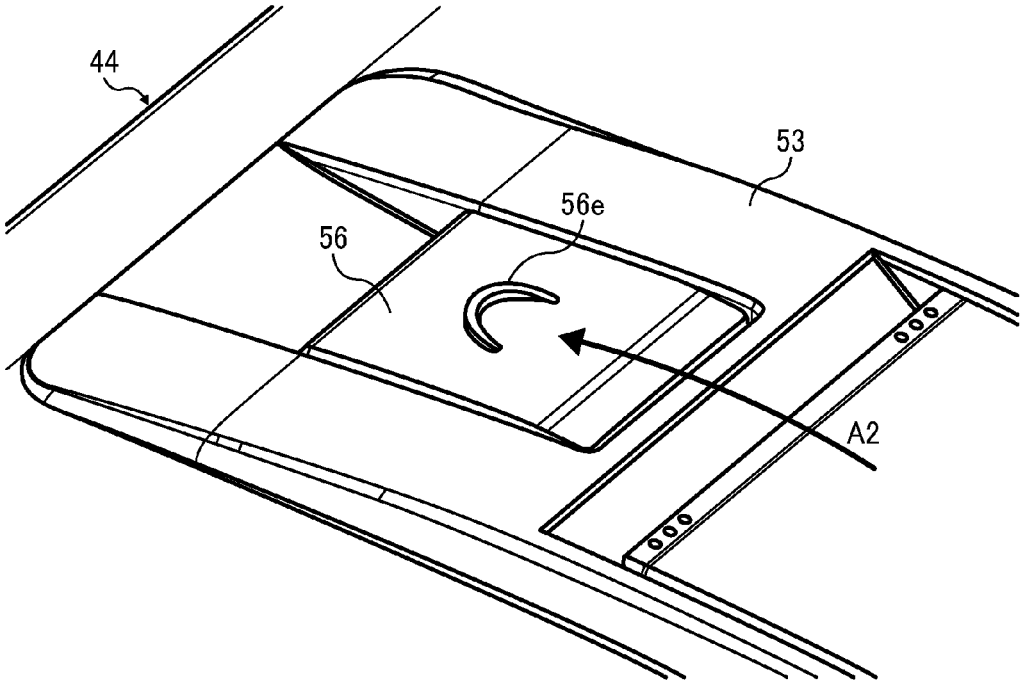
FIG. 22 is a perspective view illustrating the paper output tray.

In the present embodiment, the finger pull handle 56*e* is formed in the shape of a recess on the stopper 56 as illustrated in FIG. 10. However, as illustrated in FIGS. 21 and 22, the finger pull handle 56*e* may be formed in the shape of a protrusion. In this case, the finger pull handle 56*e* can be an obstacle to the paper to be discharged to the paper tray body 53. To prevent the paper from being caught and blocked by the finger pull handle 56*e*, it is desirable that the finger pull handle 56*e* is formed in the shape of a protrusion that gradually slopes upward as the paper moves in the paper output direction A2. By contrast, if the finger pull handle 56*e* is formed in the shape of a recess, the paper to be discharged to the paper tray body 53 is hardly hindered or blocked by the finger pull handle 56*e*. Accordingly, good consistency of output papers can be obtained and a more compact design of the image forming apparatus 100 can be achieved.

In the above-described embodiment, two projections 56*a* are disposed in parallel facing each other on the stopper 56 as a pair, so that the position of the stopper 56 in the folded state remains stable. Accordingly, operability of the stopper 56 is enhanced. In addition, the stopper 56 is supported by providing more than one projection. Consequently, a load applied to an area on the paper tray body 53 in which the projections 56*a* slidably move can be distributed, and therefore a friction force exerted between the projections 56*a* and the paper tray body 53 can be reduced. However, the number of the projections 56*a* to be provided to the stopper 56 is not limited thereto. For example, three or more projections or a single projection can be applied to the stopper 56.

In the present embodiment, the paper tray body 53, the paper support extension 55, and the stopper 56 are formed with resin material. Among various materials, different materials can be selected for parts or components slidably contact each other during the operations of the image forming apparatus 100. For example, the paper support extension 55 and the paper tray body 53 are formed with different materials and the stopper 56 and the paper tray body 53 are formed with different materials. By forming parts slidably contact each other with different materials, the coefficient of friction between the parts can be reduced. Accordingly, occurrence of abnormal noise due to slidable contact of the parts and friction generated on the surfaces of the parts can be prevented.

In the present embodiment, the paper output tray 44 is equipped with the paper output unit 45 that is provided to the laser printer as the image forming apparatus 100. However, the paper output tray 44 and the paper output unit 45 are applicable to a copier, a facsimile machine, a printer, a printing machine, an inkjet recording machine, a multifunctional device including at least two features of the copier, the facsimile machine, the printer, the printing machine, and the inkjet recording machine, or another paper output tray accommodating other sheets in different sizes.

As described above, the image forming apparatus 100 has the above-described configuration in which the stopper 56 overlaps the outer surface of the paper tray body 53 in the states that the paper support extension 55 is stored and the stopper 56 is folded and stored in the recess 53*b* of the paper tray body 53 as illustrated in FIG. 6. This configuration prevents the stopper 56 from slidably moving on the paper tray body 53. By so doing, scratch or damage caused by the stopper 56 slidably moving on the paper tray body 53 can be prevented. As a result, the function and the quality of outer appearance of the image forming apparatus 100 can be enhanced.

By causing the stopper 56 to overlap the outer surface of the paper tray body 53, even when the paper support extension 55 is in the stored state, the stopper 56 can rotatably move to the standing state. Accordingly, with the configuration according to the embodiments of the present invention, the usable range of the stopper 56 can be enhanced and the paper output tray 44 and the paper output unit 45 including the paper output tray 44 can be applied to papers and recording media with various sizes.

As described above, the stopper 56 can run on the paper tray body 56 in the state that the stopper 56 is folded. With this configuration, the paper support extension 55 can be extended or stored and the stopper 56 can be raised or folded without going through a given procedures. Consequently, the operation procedures can be optionally selected or changed, thereby increasing flexibility in operation of an apparatus such as the image forming apparatus 100. Further, since various optional operation steps can be selected without following fixed steps, scratch and/or damage of parts caused by performing incorrect operation procedures can be prevented.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A paper output tray comprising:

a tray body having an outer surface on to which a sheet material is output;

a paper support extension slidably attached to the tray body and arranged switchable between a stored state in which the paper support extension is stored in an inner surface of the tray body in a storing direction and an extended state in which the paper support extension is pulled out to extend from the inner surface of the tray body in a sheet output direction; and a stopper rotatably attached to the paper support extension and arranged switchable between a folded state in which the stopper is folded to the paper support extension along the sheet output direction and a standing state in which the stopper is raised from the paper support extension in a sheet stacking direction, wherein, with the paper support extension in the stored state and the stopper in the folded state, the stopper overlaps the outer surface of the tray body, wherein the stopper comprises a tip end disposed at a leading end in the storing direction of the paper support extension, wherein the tray body comprises an edge part opposite to the tip end in the sheet output direction, wherein a first height is from an upper surface of the paper support extension to a surface of the tip end facing the upper surface of the paper support extension and a second height is from the upper surface of the paper support extension to a surface of the edge part disposed opposite the tip end of the stopper in the sheet output direction and facing the upper surface of the paper support extension, wherein, with the paper support extension in the extended state and the stopper in the folded state, the first height is greater than the second height.

2. The paper output tray according to claim 1, wherein, with the stopper in the folded state, the stopper comprises a projection projecting toward either one of the paper support extension and the tray body.

3. The paper output tray according to claim 2, wherein, with the stopper in the folded state, the projection is formed in a rib shape extending along the storing direction of the paper support extension.

4. The paper output tray according to claim 1, wherein the stopper comprises a sloped portion on the projection thereof in the vicinity of the tip end on a side of an opposing surface facing either one of the paper support extension and the tray body, wherein, with the stopper in the folded state, the sloped portion is formed to incline in a direction opposite the storing direction of the paper support extension toward either one of the paper support extension and the tray body.

5. The paper output tray according to claim 2, wherein the stopper comprises a top part projected from the projection thereof, wherein, with the stopper in the folded state, the top part and an adjacent area to the top part are formed in a convex curvature shape over the paper support extension in the storing direction thereof.

6. The paper output tray according to claim 2, wherein the stopper comprises an edge in a lateral cross section of the projection thereof, wherein the edge is formed in a convex curvature shape over the projection in a lateral direction that intersects the storing direction of the paper support extension.

7. A paper output tray comprising:

a tray body having an outer surface on to which a sheet material is output;

a paper support extension slidably attached to the tray body and arranged switchable between a stored state in which the paper support extension is stored in an inner surface of the tray body in a storing direction and an extended state in which the paper support extension is pulled out to extend from the inner surface of the tray body in a sheet output direction; and a stopper rotatably attached to the paper support extension and arranged switchable between a folded state in which the stopper is folded to the paper support extension along the sheet output direction and a standing state in which the stopper is raised from the paper support extension in a sheet stacking direction, wherein, with the paper support extension in the stored state and the stopper in the folded state the stopper overlaps the outer surface of the tray body, wherein, with the stopper in the folded state, the stopper comprises a projection projecting toward either one of the paper support extension and the tray body, and wherein the projection corresponds to multiple projections disposed on the stopper.

8. The paper output tray according to claim 1, wherein the stopper comprises a tip end disposed at a leading end in the storing direction of the paper support extension, the paper output tray further comprising a sloped portion provided on the outer surface of the tray body, facing the tip end of the stopper in the sheet output direction in the stored state of the paper support extension, wherein, with the paper support extension in the extended state and the stopper in the folded state, the sloped portion of the paper support extension is on an upward side of an inner surface of the tray body.

9. The paper output tray according to claim 1, further comprising a recess formed on the outer surface of the tray body, wherein the stopper is storable with respect to the recess when the stopper is in the folded state.

10. The paper output tray according to claim 1, further comprising a handle having a protrusion shape formed on a reverse side of the stopper that is opposite an upper surface of the stopper facing the paper support extension, wherein, with the stopper in the folded state, the handle is moved to switch either one of the stopper from the folded state to the standing state and the paper support extension from the stored state to the extended state.

11. The paper output tray according to claim 1, further comprising a handle having a recess shape formed on a reverse side of the stopper and opposite the paper support extension, wherein, with the stopper in the folded state, the handle is moved to switch either one of the stopper from the folded state to the standing state and the paper support extension from the stored state to the extended state.

12. The paper output tray according to claim 1, wherein the stopper and the tray body are formed with different materials.

13. The paper output tray according to claim 1, wherein the paper support extension and the tray body are formed with different materials.

14. A paper output unit comprising:

a sheet discharging unit to discharge a sheet material outside an image forming apparatus; and the paper output tray according to claim 1.

15. An image forming apparatus comprising:

a sheet feeding body to feed a sheet material;

an image forming unit to form an image supplied thereto by the sheet feeding body; and the paper output unit according to claim 14.

16. The image forming apparatus according to claim 15, wherein the image forming apparatus corresponds to one of a copier, a facsimile machine, a printer, a printing machine, an inkjet recording machine, or a multifunctional machine having at least two functions of the copier, the facsimile machine, the printer, the printing machine, and the inkjet recording machine.

17. A paper output tray comprising:

a tray body to which a sheet material is output;

a paper support extension slidably attached to the tray body and arranged switchable between a stored state in which the paper support extension is stored in an inner surface of the tray body in a storing direction and an extended state in which the paper support extension is pulled out to extend from the inner surface of the tray body in a sheet output direction; and a stopper rotatably attached to the paper support extension and arranged switchable between a folded state in which the stopper is folded to the paper support extension along the sheet output direction and a standing state in which the stopper is raised from the paper support extension in a sheet stacking direction, wherein, with the paper support extension in the stored state and the stopper in the folded state, the stopper overlaps an outer surface of the tray body, wherein the stopper comprises a tip end disposed at a leading end in the storing direction of the paper support extension, wherein the tray body comprises an edge part opposite to the tip end in the sheet output direction, wherein a first height is from an upper surface of the paper support extension to a surface of the tip end facing the upper surface of the paper support extension and a second height is from the upper surface of the paper support extension to a surface of the edge part disposed opposite the tip end of the stopper in the sheet output direction and facing the upper surface of the paper support extension, and wherein, with the paper support extension in the extended state and the stopper in the folded state, the first height is greater than the second height.

18. A paper output tray comprising:

a tray body to which a sheet material is output;

a paper support extension slidably attached to the tray body and arranged switchable between a stored state in which the paper support extension is stored in an inner surface of the tray body in a storing direction and an extended state in which the paper support extension is pulled out to extend from the inner surface of the tray body in a sheet output direction; and a stopper rotatably attached to the paper support extension and arranged switchable between a folded state in which the stopper is folded to the paper support extension along the sheet output direction and a standing state in which the stopper is raised from the paper support extension in a sheet stacking direction, wherein, with the paper support extension in the stored state and the stopper in the folded state, the stopper overlaps an outer surface of the tray body, wherein, with the stopper in the folded state, the stopper comprises a projection projecting toward either one of the paper support extension and the tray body, and wherein, with the stopper in the folded state, the projection is formed in a rib shape extending along the storing direction of the paper support extension.

19. A paper output tray comprising:

a tray body to which a sheet material is output;

a paper support extension slidably attached to the tray body and arranged switchable between a stored state in which the paper support extension is stored in an inner surface of the tray body in a storing direction and an extended state in which the paper support extension is pulled out to extend from the inner surface of the tray body in a sheet output direction; and a stopper rotatably attached to the paper support extension and arranged switchable between a folded state in which the stopper is folded to the paper support extension along the sheet output direction and a standing state in which the stopper is raised from the paper support extension in a sheet stacking direction, wherein, with the paper support extension in the stored state and the stopper in the folded state, the stopper overlaps an outer surface of the tray body, wherein, with the stopper in the folded state, the stopper comprises a projection projecting toward either one of the paper support extension and the tray body, wherein the stopper comprises a top part projected from the projection thereof, and wherein, with the stopper in the folded state, the top part and an adjacent area to the top part are formed in a convex curvature shape over the paper support extension in the storing direction thereof.

20. A paper output tray comprising:

a tray body to which a sheet material is output;

a paper support extension slidably attached to the tray body and arranged switchable between a stored state in which the paper support extension is stored in an inner surface of the tray body in a storing direction and an extended state in which the paper support extension is pulled out to extend from the inner surface of the tray body in a sheet output direction; and a stopper rotatably attached to the paper support extension and arranged switchable between a folded state in which the stopper is folded to the paper support extension along the sheet output direction and a standing state in which the stopper is raised from the paper support extension in a sheet stacking direction, wherein, with the paper support extension in the stored state and the stopper in the folded state, the stopper overlaps an outer surface of the tray body, wherein, with the stopper in the folded state, the stopper comprises a projection projecting toward either one of the paper support extension and the tray body, wherein the stopper comprises an edge in a lateral cross section of the projection thereof, and wherein the edge is formed in a convex curvature shape over the projection in a lateral direction that intersects the storing direction of the paper support extension.

21. A paper output tray comprising:

a tray body to which a sheet material is output;

a paper support extension slidably attached to the tray body and arranged switchable between a stored state in which the paper support extension is stored in an inner surface of the tray body in a storing direction and an extended state in which the paper support extension is pulled out to extend from the inner surface of the tray body in a sheet output direction; and a stopper rotatably attached to the paper support extension and arranged switchable between a folded state in which the stopper is folded to the paper support extension along the sheet output direction and a standing state in which the stopper is raised from the paper support extension in a sheet stacking direction, wherein, with the paper support extension in the stored state and the stopper in the folded state, the stopper overlaps an outer surface of the tray body, wherein, with the stopper in the folded state, the stopper comprises a projection projecting toward either one of the paper support extension and the tray body, and wherein the projection corresponds to multiple projections disposed on the stopper.

* * * * *